United States Patent [19]

Rapata et al.

[11] 4,126,369

[45] Nov. 21, 1978

[54] ELECTRONIC COMPONENT TERMINAL BRIDGING ASSEMBLY

[75] Inventors: George M. Rapata, Schaumburg; William E. Ruehl, Wheeling, both of Ill.

[73] Assignee: Illinois Tool Works, Chicago, Ill.

[21] Appl. No.: 861,921

[22] Filed: Dec. 19, 1977

[51] Int. Cl.[2] ..... H01R 3/00

[52] U.S. Cl. ..... 339/113 R; 174/52 R; 339/277 R

[58] Field of Search ..... 174/52 R, 92; 339/113 R, 113 B, 97 P, 277 R

[56] References Cited

U.S. PATENT DOCUMENTS

| | | | |
|---|---|---|---|
| 3,187,295 | 6/1965 | Huska | 339/113 B |
| 3,234,498 | 2/1966 | Logan | 339/277 R |
| 3,255,399 | 6/1966 | Parks | 174/52 R |

*Primary Examiner*—Roy Lake

*Assistant Examiner*—DeWalden W. Jones

*Attorney, Agent, or Firm*—Jack R. Halvorsen; Robert W. Beart

[57] ABSTRACT

A compact electronic component and contact retainer device for use with electrical wiring terminal blocks having a plurality of adjacently positioned elongated terminal means disposed in aligned successive rows. The device includes a two-piece dielectric housing designed to accept an electronic component associated with spaced contacts adapted to accept a pair of spaced terminals in a row falling in a common plane. The housing, in its interior, specifically provides integral means for orienting and complementary retention of the contacts and electronic component means connected thereto while the component and the outside of the housing includes indicia means for proper orientation of the device relative to the terminals to thereby insure the proper polarity or direction of current flow through the electronic component means contained therein.

12 Claims, 11 Drawing Figures

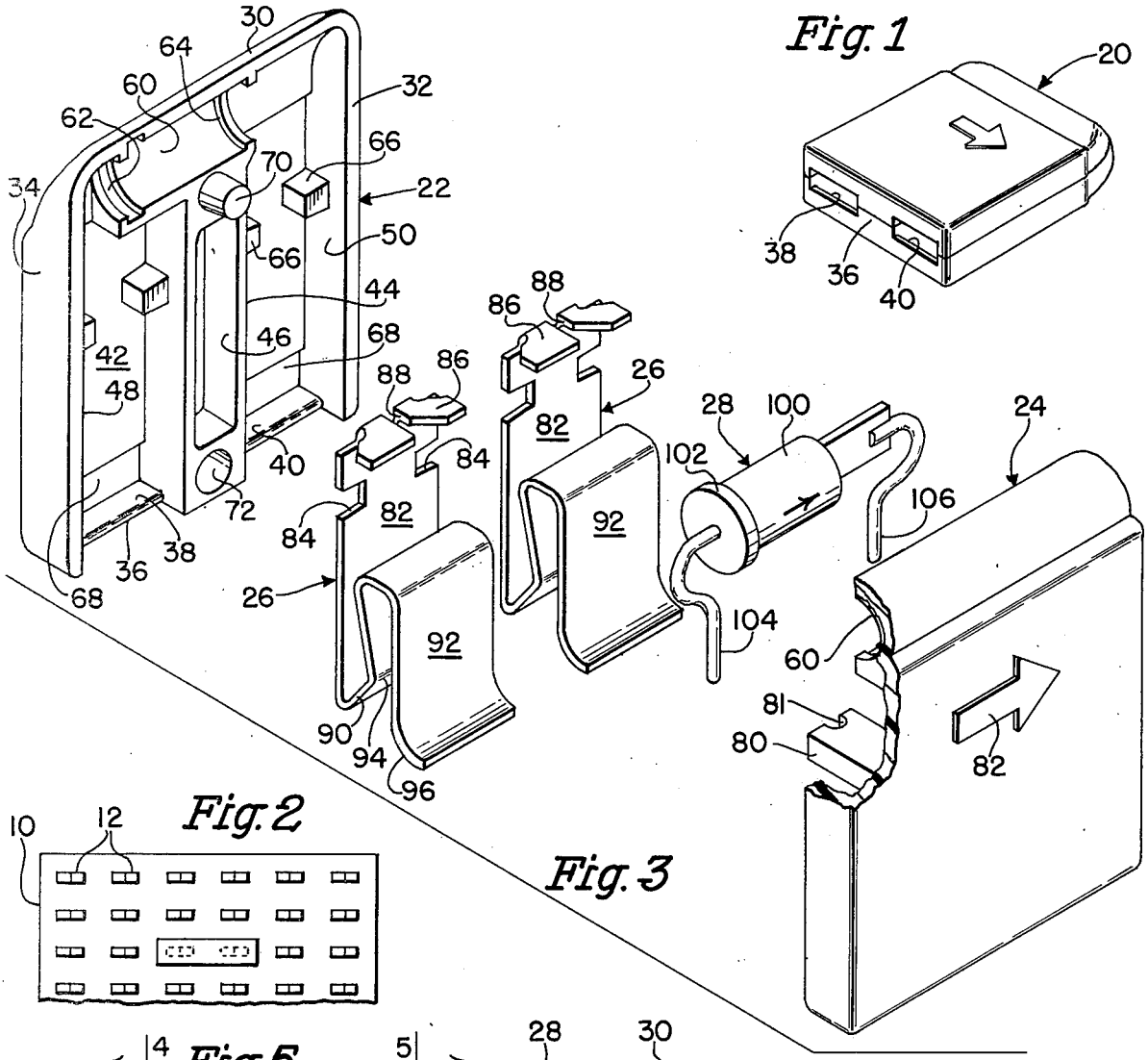
Fig. 1
Fig. 2
Fig. 3
Fig. 5
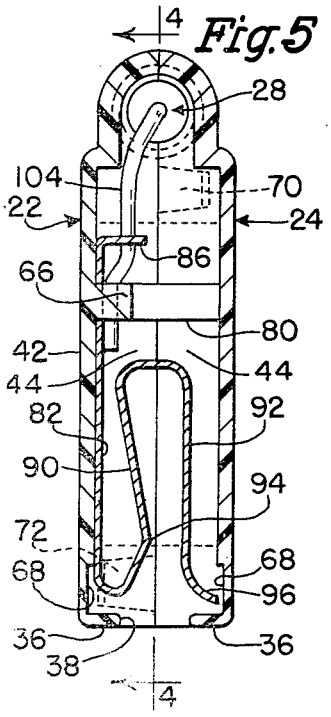
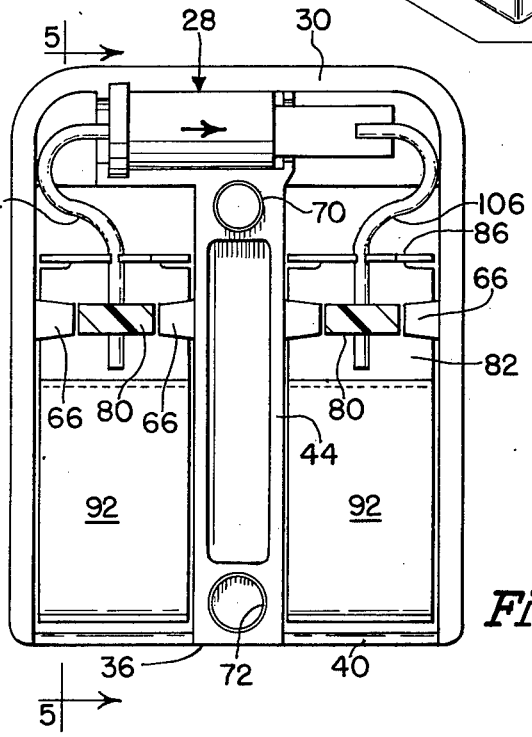
Fig. 4

Fig. 6
PRIOR ART
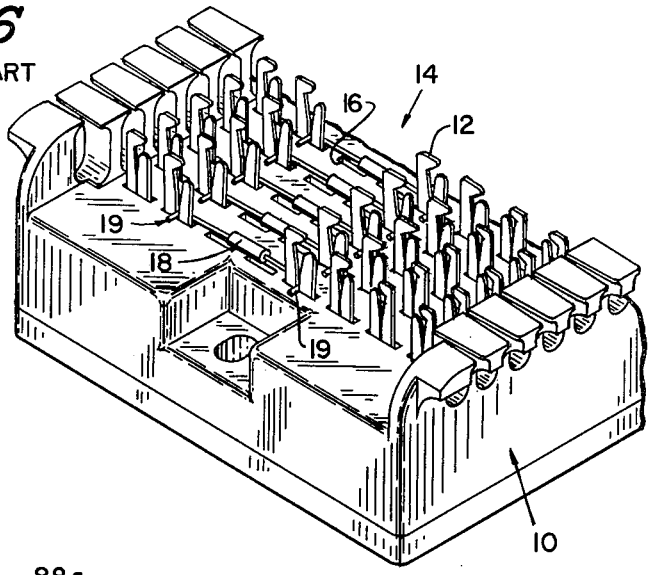
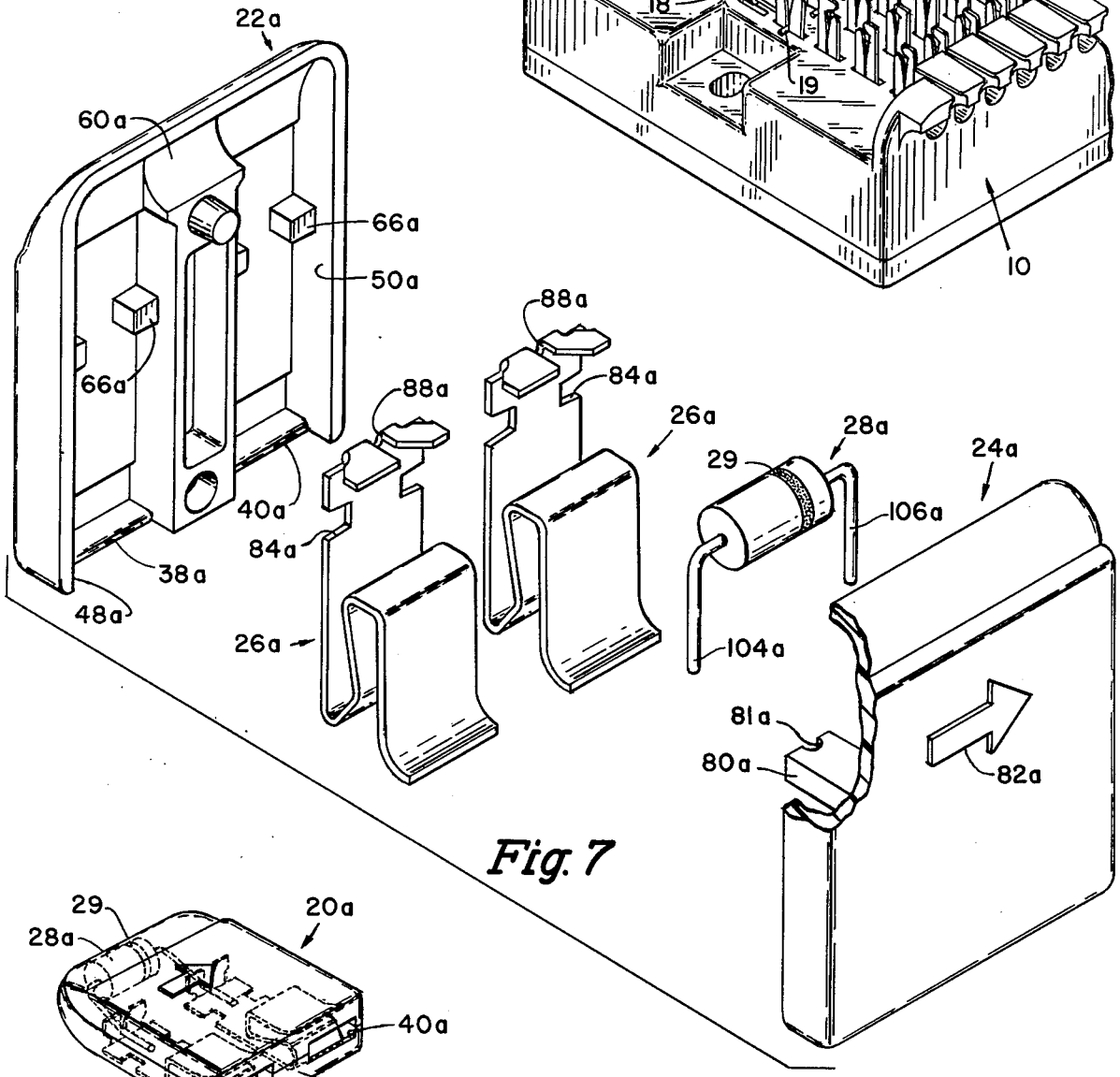
Fig. 7
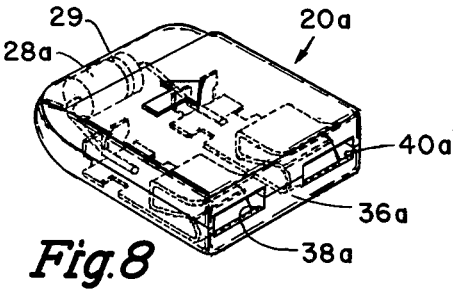
Fig. 8

Fig. 9
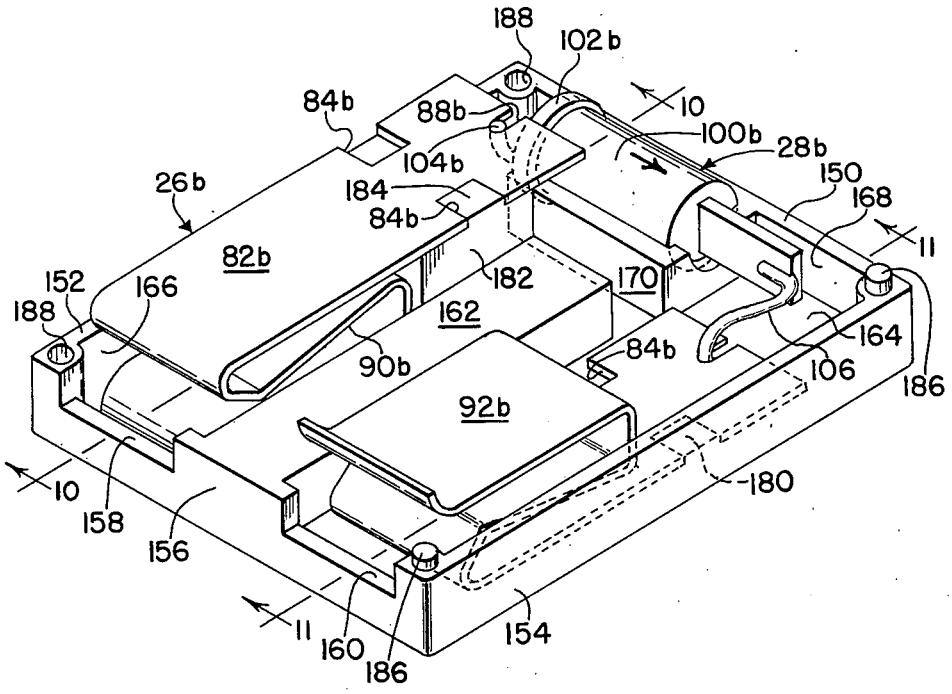
Fig. 10
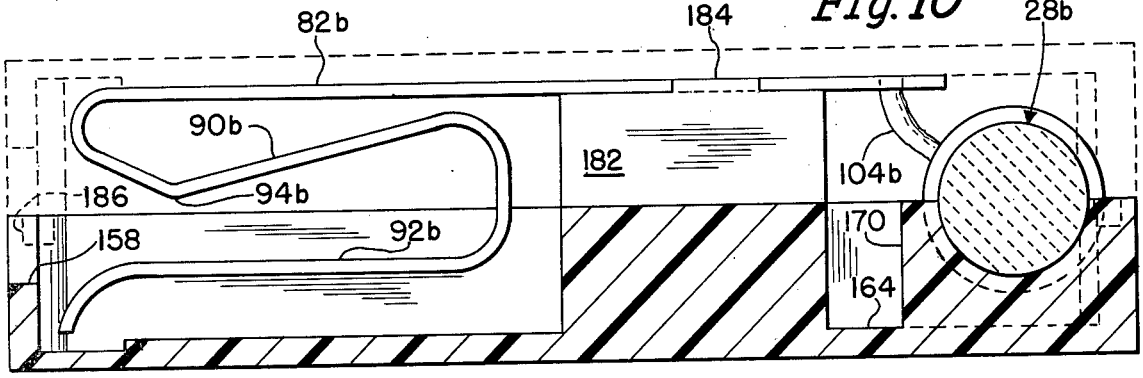
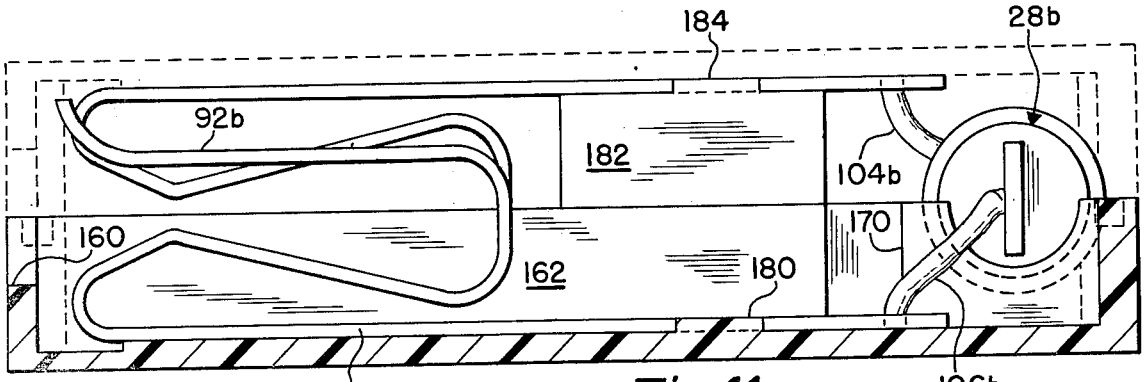
Fig. 11

ELECTRONIC COMPONENT TERMINAL BRIDGING ASSEMBLY

BACKGROUND OF THE INVENTION

This invention relates primarily to electronic component and contact retainer devices for use with and for establishment of matrix type circuits on terminal blocks used with key telephone systems. We are aware of two co-pending applications for United States Letters Patent which contemplate various forms of related devices; the first application having Ser. No. 810,532, filed June 27, 1977, assigned to Illinois Tool Works Inc. of Chicago, Ill., the assignee of this present invention; and the second application having Ser. No. 811,293 filed June 29, 1977, which it is our understanding will be assigned to Bell Laboratories of Holmdel, N.J., and Illinois Tool Works Inc. of Chicago, Ill. The inventions contemplated in these two co-pending applications contemplate protective devices which are arranged to accept terminals disposed in adjacent rows of terminals lying in spaced planes as opposed to the present invention wherein the devices of the present invention are so arranged to accept terminals disposed in a single row falling in a common plane.

The telephone companies have, for a period of time, contemplated installations to provide specialized services for particular customers in office buildings and hotels. Unfortunately, the space allotted for telephone equipment is minimal and hence the addition of other special features is restricted. A solution to these problems is to utilize electronic components in the intermediate terminal blocks used on the key telephone relay equipment itself and/or at multiple phone installation interconnecting blocks. Such blocks consist of rows of terminals that are flat, split beam members adapted to accept wire conductors between the split portions of each terminal.

Attempts have been made to remove terminals from the blocks and wire electronic components directly to adjacent terminals in a common row of the terminal blocks; however, component lead wires have a larger diameter than common copper telephone lead wires and when they were both inserted into a slot of a split planar blade-like terminal, the thinner telephone wires did not maintain tight contact, thereby jeopardizing the integrity of the connection and resulting in noise on telephone lines. Additionally, the labor of removing terminals from a terminal block was time consuming and the installation of the electronic component was difficult due to the close proximity and cramped spacing of adjacent rows of terminals in such blocks. Further, the removal of terminals from a block restricts useage of that block in later possible modifications to the circuitry.

BRIEF SUMMARY OF THE INVENTION

The present invention relates to a compact electronic component retainer which will be acceptable between adjacent co-planar terminals in a common row of a communication terminal block. Such a retainer includes a two-piece dielectric body which encloses an electronic component spaced from and connected to spaced contacts within said body with the contacts each having an open throat which is adapted to accept the in-line terminals found in a common row falling in a single plane.

A distinct advantage of the present invention is the ability to install this retainer over the free ends of the planar upstanding terminals without disturbing the integrity of the connections between the telephone wires and the terminals.

The body portions can be fabricated from transparent types of materials which permit color codes banded on the electronic components to be observed by the user. These colored bands not only provide indicia means for identifying the type of component, i.e. a diode, capacitor, resistor, etc., but also indicate the required direction of current flow. Since a common body or housing can be used for a variety of electronic components, due to its transparent quality, there is a large cost saving due to the elimination of multiple types of housings and different indicia means.

By using a variety of components in different portions, it is possible to establish an electronic matrix with a plurality of these parts. This virtually permits making a terminal block into a circuit board with a wide variety of possibilities. A few such applications could include use of telephone wiring for message waiting lights; background music while on hold; conference calls; paging systems where the telephone serves as the microphone; privacy on a particular phone where a third party could not listen in on an extension phone; fire and/or burglar alarm systems which automatically call all phones in a particular area of a building; interconnects to competitive telephone systems; prevention of unauthorized long distance calls; and data transmission where components would clean up voltage transients which compromise the integrity of data transmission by removing undesired binary bits and maintaining preselected desired binary bits.

Thus, a definite advantage of the present invention is that it can be applied to existing systems to update the customer's needs with a minimum of capital investment. As one example, instead of requiring installation of new exotic equipment on each floor of an office building, the existing terminal wiring blocks can be used to tie into a single remote unit installed in a convenient location, thereby saving valuable space.

Another object of the present invention is to provide a device of the type indicated above which can be economically fabricated, economically assembled, will provide a low profile in installed positions, can be installed with ease, readily removed and will not be readily cocked or accidentally dislodged.

Other objects of the present invention will become apparent to those skilled in the art when the specification is read in conjunction with the attached drawings.

BRIEF DESCRIPTION OF THE DRAWINGS

FIG. 1 is a perspective view of an assembled form of the present invention;

FIG. 2 is a partial plan view of a terminal block showing the device of FIG. 1 applied to a pair of adjacent terminals in a single row;

FIG. 3 is an enlarged expanded perspective view in partial section of the two body halves, contacts and electronic component used to fabricate one embodiment of the present invention;

FIG. 4 is an elevational view in partial section taken along Line 4—4 of FIG. 5;

FIG. 5 is a side elevational view taken along Line 5—5 of FIG. 4;

FIG. 6 is a partial perspective view of a terminal block as used in the prior art;

FIG. 7 is an expanded perspective view in partial section of a second embodiment of the present invention;

FIG. 8 is a perspective view of an assembled device of the type shown in FIG. 7 showing the housing or body as being transparent to permit ready identification and orientation of the electronic component contained therein;

FIG. 9 is a perspective view of a second embodiment of the present invention which utilizes two identical body portions but in this figure only showing a single half of the body for clarity in illustration;

FIG. 10 is a side elevational view in partial section taken along Line 10—10 of FIG. 9; and FIG. 11 is a side elevational view in partial section taken along Line 11—11 of FIG. 9.

BRIEF DESCRIPTION OF THE INVENTION

In the communications industry, various forms of circuit connection means are utilized. In some forms a patch-cord is used where male and female connectors are use on a temporary or semipermanent basis, while in the telephone industry it is quite common, in the United States, to use terminal blocks 10, as seen in FIGS. 2 and 6, which include rows of flat slotted beam-like terminals 12 of a well-known variety that permit a lead wire to be inserted between the two halves of the terminal to strip the wire and make contact with that terminal. In most instances, a pluarlity of two or more terminals in a simple row of terminals will be integral and interconnected under the body of the block to provide connection with a common function or circuit.

Where special services are to be provided to customers, it has been found desirable to remove a column of the spaced rows of terminals, to leave an open space designated by the numeral 14 and open holes 16 in the terminal block, as best seen in the prior art shown in FIG. 6. A suitable electronic component 18 could then be so positioned that its lead wires with bent ends 19 could be inserted into adjacent terminals of groups lying in a common co-planar row. While the component in this position is protected from accidental dislodgement, it will be appreciated that installation of the component is difficult; removal of a column 14 of terminals 12 reduces the future modification or useage of that particular terminal block; and, additionally, introduces noise in the telephone circuits due to poor connections caused by the dissimilarity in the component lead wire and telephone wire diameters, as was explained hereinabove.

The present invention relates to a compact assembly consisting of two dielectric halves forming a body portion which, before assembly, will accept contacts in a side-by-side common row relationship internally of the device while mounting the electronic component, such as a diode, resistor, capacitor, etc., in a horizontal position at one end of the body between the spaced contacts opposite to the ports adapted for acceptance of the terminals. Such a compact retainer device is generally designated by the numeral 20 and includes a pair of body portions 22 and 24, a pair of contacts 26 and an electronic component 28.

Referring now to FIGS. 3 through 5, the housing or body in the present embodiment includes two half portions 22 and 24. Each half of the housing is a generally thin-wall, box-like member substantially rectangular in configuration having a top end wall 30, side walls 32 and 34, and a bottom 36 having a pair of apertures or ports 38 and 40 spaced apart from one another. The ports 38 and 40 lie in an in-line relationship in a common plane falling on the juncture line of the two half portions.

The base 42 of the box-like configuration, in each half, carries a centrally disposed longitudinal member 44, with said member being recessed as at 46 to conserve materials and with member 44 extending from the bottom end 36 a substantial portion of the distance towards the top end 30. Members 44 in each half thereby define, when assembled, a pair of spaced, longitudinally disposed chambers 48 and 50 which communicate with ports 38 and 40, respectively. Adjacent the upper end 30 and rising from base 42 is a second element 60 that is transversely disposed perpendicularly to member 44. Element 60, in the present embodiment, is concave and adapted to accept one half of a cylindrical body. At one lateral end of this embodiment of element 60 there is a locating means or groove 62, while at the other end there is a flange or shoulder means 64 for purposes best set forth hereinafter. The elements 60 and their elongated concave shape serve to form a third chamber transversely disposed relative to chambers 48 and 50 and to communicate between said two chambers.

Locating means or protuberances 66 extend upwardly from base 42 of body portion 22 into the respective chambers. There are preferably two protuberances in each chamber spaced from the end 36 and slightly tapered in configuration for purposes best set forth hereinafter. The two protuberances 66 provided in each chamber extend inwardly in spaced opposed relationship from the respective side walls 32 and 34 and the centrally disposed member 44.

The base 42 is recessed, as at 68, in each half and in each of the chambers 48 and 50 adjacent to the respective ports 38 and 40, for purposes best set forth hereinafter.

Orienting or locating means, such as the tapered post 70 and the tapered bore 72, are located in reversed position in the longitudinally disposed member 44 in each half body portion. Such elements could be disposed at other locations as is well known in the art.

The second half of the body 24 has a construction substantially identical to body element 22 with the exception that it does not have the opposed protuberance means 66 but rather includes a restraining post 80 which extends upwardly from the base 42 in a position substantially aligned with the protuberance means 66 and having a width equal to or less than the spacing between opposed pairs of protuberances 66. The length of retentive bearing post 80 is substantially equal to the combined height of the side walls 32 and 34 less the thickness of the contact member 36. It also includes a centrally disposed depression or groove 81, the purpose of which will be explained hereinafter.

In this embodiment, at least one of the halves forming the housing or body includes an indicia means, such as the embossed arrow 82, for use in orienting the matrix or housing in the proper direction of use on the terminal block 10.

A pair of contacts 26 are utilized and include a flat, elongated first portion 82 with notch means 84 opening outwardly in predetermined relation from opposite edges and generally adjacent one end thereof. The notches 84 are substantially complementary to the protuberances 66. Suitable means, such as the perpendicular flange 86 which is slotted as at 88, are provided for purposes of solderless acceptance of wire-like connection means. At the opposite end of the flat, elongated first portion 82 is an integral second portion 90 that is reversely bent from the first portion and then connected to an integral reversely bent third portion 92. It will be noted that second portion 90 extends upwardly and away from first portion 82 and thence inwardly along a bent line 94. The third portion 92 is flared outwardly as at 96 to form a substantially S-shaped contact member having a smooth open throat between the second and third portions with the spacing between said second and third portions 90 and 92 being adapted for acceptance of the terminals 12 in resilient gripped relation. The electronic element 28 shown in this embodiment is one form of a diode and includes a cylindrical body 100, an orienting flange 102 disposed at one end thereof and a pair of leads 104 and 106 that are disposed perpendicular to the axis of the cylindrical body 100. The length of body 100 is acceptable within the cavity 60 with one end of the body resting against the flange 64 and the flange 102 being disposed and acceptable complementarily within the groove 62.

To assemble the present device, a pair of identical contacts 26 are each disposed within one of the chambers 48 and 50 with the protuberances 66 complementarily filling the notches 84 so that the contacts 26 are oriented relative to the body. The electronic component is then placed within the cavity or third chamber 60 with the leads 104 and 106 disposed within the notches 88 in electrical contact with the contacts 26. The second body half 24 is then superimposed with the locating post 70 being acceptable within a complementary bore and a similar post being accepted within the bore 72. The retentive bearing posts 80 are brought to bear against the elongated flat portion 82 of the contacts 26 to maintain said flat, elongated portion 82 in assembled juxtaposed relation to the base 42. The leads 104 and 106 extend axially between the protuberances 66, and the groove 81 in the end of retentive bearing post 80 bears against the wire leads 104 and 106 and maintains them in positive contact with the elongated first portion 82 of the contacts 26, as best seen in FIGS. 4 and 5. This insures capturing the leads against lateral movement as well as good electrical contact between the two contacts 26 and the respective leads of electronic device 28. Alternatively, the leads 104 and 106 can be clipped shorter so that their sole electrical contact will be when they are forced into the slots 88.

Referring to FIG. 5, it will be noted that the end wall 36, which forms the port 38, forms a smooth opening for introduction of a terminal member 12 into the open throat of the contact 26. Additionally, referring to FIG. 5, it will be noted that the recesses 68 in the base 42 of each of the body portions 22 and 24 will accept a limited lateral movement of the flared free end 96 of the contact as well as to accommodate bending between the first portion 82 and the second portion 90 and to permit the expansion of portions 90 and 92 when the terminal is introduced therebetween.

The flange 102 on the electronic component 28, in the present instance a particular form of diode, insures the proper orientation and it will be noted that this combined with the indicia means 82 insures the proper useage of the device to control the direction of current desired.

The two body portions 22 and 24 are of a dielectric material and may be suitably formed as by injection molding or compression molding from any materials suitable for the requirements. The contacts 26 are sheet metal while the electronic component 28 will be dependent upon the particular characteristics wished to be imposed in the circuitry involved. After the two halves of the case are assembled with the contacts and component in position within the three chambers, the case can be secured and formed into a single unit by suitable means, such as adhesive, sonic welding or heat welding.

A second embodiment of the present invention is disclosed in FIGS. 7 and 8 wherein similar parts are designated by similar numerals with the addition of the suffix "*a*." The features of this embodiment **20*a* are substantially identical to the previous embodiment; namely, the contacts 26*a* and the body portions 22*a* and 24*a* have the same cooperative means for positioning the contacts 26*a* relative to protuberances 66*a* and bearing posts 80*a* in the chambers 48*a* and 50*a*. Thus, each of the contacts 26*a* present a smooth open throat to the ports 38*a* and 40*a***.

A minor variation occurs in that the third chamber formed by element **60*a* does not include the groove 62 and flange 64 found in the first embodiment. It was found that most resistors and capacitors, as well as certain diodes, were formed with a simple cylindrical body of a relatively constant diameter. By providing indicia means on the body portion of the component, such as a color coded band 29 adjacent one end thereof, and further by forming the body portions 22*a* and 24*a* from a non-opaque transparent or translucent material so that the colored indicia means 29 was externally visible, it was possible to utilize a common body for a plurality of different electronic components. This eliminated the need for different identifiable bodies for each type of component. The raised arrow indicia means 82*a*** may also be placed on the exterior of the body or housing at any desired location.

The interconnection of integral leads **104*a* and 106*a* of the component 28*a* with the slots 88*a* in the contacts 26*a*, plus the capturing of the ends of the leads by groove 81*a* in bearing post 80*a*, is adequate to prevent lateral movement of and restrain the component 28*a* in the chamber formed by element 60**.

Thus, the non-opaque body portions permit the installer to readily identify a particular component and to orient the component for correct direction of current flow. The colored ring is at an end of the cylindrical body which represents the direction of egress of the current through the component.

A third embodiment of the present invention is disclosed in FIGS. 9 and 11 wherein similar parts will be designated by similar numerals with the addition of the suffix "*b*." The contacts **26*b* are substantially identical to the other embodiments in that they include an elongated flat portion 82*b* having notches 84*b* adjacent one end thereof and opening outwardly through opposite edges and having second and third integrally reversely bent portions 90*b* and 92*b* connected to the flat portion 82*b*. At the end remote from the open throat the connection portion of this contact does not include the perpendicular flange means 86*b* but rather, in this embodiment, is a proplanar continuation of the first portion 82*b* and is slotted as at 88*b* to accept the leads 104*b* and 106*b*, respectively. It will be recognized that the contacts 28, with flange means 86**, would be equally useable in this embodiment.

The electronic component **28*b* is substantially identical to the previously described components, in that it is provided with a body portion 100*b*, lead means 104*b*** and 106*b* and may optionally be provided with flanged end 102*b*.

The major structural difference in this embodiment is that the housing is formed from identical halves. FIG. 9 only shows one-half of the housing or body for clarity in illustration. Each identical half includes a top wall 150, side walls 152 and 154, a bottom end wall 156 having a pair of in-line, spaced ports 158 and 160. A central longitudinally disposed dividing means 162 is integral with and rises upwardly from the base 164 with the dividing means 162 forming a pair of longitudinally disposed chambers 166 and 168. At the upper end a third chamber is formed by the concave hollow semi-cylindrical portion 170 which is substantially equal to the previously described hollow chamber 60. Element 170 may, if desired, be provided with an end wall and recessed groove for orientation of the electronic component 28*b*.

In this embodiment a single protuberance 180 is provided in chamber 168 and is positioned adjacent wall 154 and rises from the base 164. The second chamber 166 is provided with an elevated post-like element 182 that substantially extends across the entire width of chamber 166. Extending upwardly from the free end surface of post-like element 182 is a protuberance means 184 that is on the inner or centrally disposed side edge of the chamber 166 which, as seen in FIG. 6, would be the righthand side of the chamber in the same fashion as the protuberance 180 is in the righthand side of the chamber 168. Post 182 has a predetermined length as it rises from the base of chamber 166 that is substantially equivalent to the combined depths of chambers 166 and 168 less the thickness of the flat elongated portion 82*b* of a contact 28*b*, as will be described hereinafter.

To assemble a connective matrix of the type contemplated in this embodiment, a contact 28*b* is disposed in the chamber 168 with its flat elongated portion 82*b* in juxtaposition to the base 164 and one of its notches 84*b* complementarily engaging the protuberance 180. The second contact 28*b* is inverted or rotated 180° about its longitudinal axis and placed with the opposite surface of the elongated flat portion 82*b* in contact with the exposed surface of the retaining post 182 and with its opposite notch 84*b* engaging the protuberance 184. The electronic component 28*b* is connected through its leads 104*b* and 106*b* into the slots 88*b* at the free extremity of the contacts 28*b*.

An identical second half of the housing is then inverted and super-imposed on the first half with mating posts 180 engaging the complementary bore 182 in the opposite corners. When the second half of the housing is brought to bear, its wall 154 will rest atop wall 152, and vice versa, of the first half shown in FIG. 6. The position of the second half of the housing is shown in phantom in FIGS. 7 and 8 and with the supporting post 182 of the second housing half extending into the cavity 168 and its protuberance 184 extending into the open notch 84*b* while the protuberance 180 will extend into the open notch 84*b* of the contact 26*b* disposed in cavity 166 to thereby totally secure the contacts in juxtaposed inverted relation relative to the base portion 164 of both identical halves, as generally shown in FIGS. 7 and 8.

The fabrication techniques and materials for this embodiment are substantially identical to those of the other embodiment and the retention of the two halves of the housing as an assembled unit can be accomplished by known techniques as explained hereinabove.

Thus, the embodiments of the present invention facilitate a simple, economically fabricated and assembled connecting matrix device which bears indicia means for identification and/or orientation of the device and permits ready utilization by the installing personnel. The function and operation of all embodiments are substantially identical in that the open throat formed by the contacts 28 are disposed in an in-line relation so that they will accept adjacent terminals in a common row fallling in the same plane. Other forms and modifications will be apparent to those skilled in the art.

I claim:

1. A generally rectangular connector matrix device for electronically interconnecting two adjacent spade-like terminals lying in a common plane, said block including a two-piece housing having a pair of spaced parallel elongated chambers which open through spaced port means in one end of said housing, said port means lying in in-line relationship in a common plane, a third chamber interconnecting said parallel chambers and disposed transversely of said housing adjacent the other end thereof, a pair of identical resilient contact means each being disposed in one end of said parallel chambers and providing a smooth open throat facing said port means and disposed in in-line relationship along said common plane, mutually cooperative means in each of said parallel chambers and on each of said contact means for retaining them in predetermined relation within said housing, electronic component means complementarily retained within said third chamber and means for interconnecting said electronic component means to said contact means.

2. A matrix device of the type claimed in claim 1 wherein said contact means each includes a flat elongated first portion with notch means intermediate its length, protuberance means in said chambers complementary to said notch means for orienting said contact means relative to said chamber, means adjacent one end of each contact for solderless acceptance of said means for interconnection with said electronic means, an integral second portion connected to and reversely bent back on said first portion and an integral reversely bent third portion connected to said second portion to form a contact which in cross-section is generally S-shaped and provides said open throat between said second and third portions for accepting said terminal in gripped relation.

3. A matrix device of the type claimed in claim 2 wherein each of said parallel chambers includes means extending from one half of said housing for bearing on said contact in the other half of said housing to retain said contact and insure positionment of said contact relative to said orienting protuberance means.

4. A matrix device of the type claimed in claim 3 wherein said electronic component includes common indicia means for identification and orientation, said housing including means for facilitating identification and orientation by an installer.

5. A matrix device of the type claimed in claim 4 wherein said housing means includes non-opaque material forming at least a portion of said housing surrounding said electronic component, said indicia means carried by said component being a color coded band surrounding the body of said component at a predetermined location whereby the said component can be visually observed through said housing for purposes of identification and orientation.

6. A matrix device of the type claimed in claim 4 wherein said third chamber includes means for complementary acceptance of means on said electronic component means to insure proper orientation thereof and indicia means on the exterior of said housing indicating such orientation to insure proper useage in order to orient the direction of current flow through said electronic means.

7. A matrix device of the type claimed in claim 6 wherein said electronic component means is selected from the class including diodes, resistors and capacitors.

8. A matrix device of the type claimed in claim 2 wherein said one end of said contact is bent perpendicular to said flat portion and includes a central slot for grasping a wire-like conductor serving as the interconnecting means between said contact and said electronic component means.

9. A matrix device of the type claimed in claim 3 wherein said housing includes a relatively rigid thin wall shell defined by said two halves, means extending into said shell forming said chambers, opposed spaced flange means defining said port means, said flange means overlying the free end of said third portion along one edge of each port and overlying the bend between the first and second portions of said contact along the opposite edge of said port to thereby insure smooth introduction of said terminal into said open throat.

10. A matrix device of the type claimed in claim 9 wherein said housing includes two dissimilar halves, the first half adapted to accept said contacts in identical dispositions with said first portion lying against the inner surface of said thin wall shell, said protuberance means extending upwardly away from said inner surface and being accepted in complementary relation to said notch means, said means for retentive bearing on said contact including a pair of post-like elements extending away from the inner surface of the second half of said housing and adapted to abut said first portion of the contact when the two halves are in juxtaposition to form said housing, and means for orienting said two halves relative to each other.

11. A matrix device of the type claimed in claim 9 wherein said housing is formed of two identical halves which accept two identical contacts, each half includes a first chamber which accepts said first portion of a first contact in juxtaposed relation to the inner surface of said thin wall shell, a second chamber including support means for maintaining the first portion of a second contact in spaced inverted relation relative to said inner surface of said thin wall contact with said two contacts being identical but positioned in parallel inverted relationship by 180° rotation along their respective axes relative to one another, and the position of said two contacts relative to the second identical half of the housing being the reverse of their position relative to the first identical half.

12. A matrix device of the type claimed in claim 11 wherein each contact includes a notch on opposite sides, said first chamber and said second chamber each having a simple protuberance means for engaging one said notch whereby when said identical halves are juxtaposed to form said housing the protuberance means of the two halves will engage both notches, said support means in the second chamber of one half extending beyond its supporting shell into the first chamber of the other half to serve as the said means for retentive bearing on one of said contacts, and means for orienting said two halves of the housing relative to each other.

* * * * *